US009133846B2

(12) United States Patent
Kobayashi et al.

(10) Patent No.: US 9,133,846 B2
(45) Date of Patent: Sep. 15, 2015

(54) SCROLL FLUID MACHINE HAVING A SEALED COMPRESSION CHAMBER

(71) Applicant: Hitachi Industrial Equipment Systems Co., Ltd., Chiyoda-ku, Tokyo (JP)

(72) Inventors: Yoshio Kobayashi, Ebina (JP); Kiminori Iwano, Sagamihara (JP); Yoshiyuki Kanemoto, Samukawa (JP); Koichi Tashiro, Chigasaki (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 13/953,910

(22) Filed: Jul. 30, 2013

(65) Prior Publication Data

US 2014/0119970 A1 May 1, 2014

(30) Foreign Application Priority Data

Oct. 31, 2012 (JP) ..... 2012-239770

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 29/00*** | (2006.01) |
| ***F04C 18/02*** | (2006.01) |
| ***F01C 1/02*** | (2006.01) |

(52) U.S. Cl.

CPC ..... *F04C 29/0028* (2013.01); *F01C 1/0215* (2013.01); *F04C 18/0215* (2013.01)

(58) Field of Classification Search

USPC ..... 418/1, 55.1–55.6, 57, 104, 270

See application file for complete search history.

(56) References Cited

U.S. PATENT DOCUMENTS

| | | | | |
|---|---|---|---|---|
| 5,106,279 | A | 4/1992 | Richardson, Jr. | |
| 7,207,788 | B2 * | 4/2007 | Sato | 418/55.6 |
| 7,458,152 | B2 * | 12/2008 | Sato | 418/55.5 |
| 7,458,788 | B2 * | 12/2008 | Iwano et al. | 418/55.5 |
| 2005/0262689 | A1 | 12/2005 | Sato | |

FOREIGN PATENT DOCUMENTS

| | | | | |
|---|---|---|---|---|
| JP | 5-126069 | A | 5/1993 | |
| JP | 2005-337189 | A | 12/2005 | |
| JP | 2006097656 | A * | 4/2006 | F04C 18/02 |
| JP | 2007-162602 | A | 6/2007 | |
| JP | 2011-38492 | A | 2/2011 | |

* cited by examiner

*Primary Examiner* — Theresa Trieu

(74) *Attorney, Agent, or Firm* — Crowell & Moring LLP

(57) ABSTRACT

A scroll fluid machine is provided that includes: a fixed scroll; an orbiting scroll opposed to the fixed scroll, the orbiting scroll orbiting with a plurality of compression chambers formed between the orbiting scroll and the fixed scroll; a drive shaft driving the orbiting scroll; and a backside plate provided between the drive shaft and the orbiting scroll, an alignment hole being provided in each of the orbiting scroll and the backside plate, and an alignment pin for alignment and a seal member for sealing the compression chambers being provided in the alignment holes.

19 Claims, 5 Drawing Sheets

SCROLL FLUID MACHINE HAVING A SEALED COMPRESSION CHAMBER

INCORPORATION BY REFERENCE

The present application claims priority from Japanese application No. JP2012-239770 filed on Oct. 31, 2012, the content of which is hereby incorporated by reference into this application.

BACKGROUND OF THE INVENTION

The present invention relates to a scroll fluid machine.

JP-A-2005-337189 discloses a scroll fluid machine that has an orbiting scroll member and a backside plate with a through-hole provided in each member, and a parallel pin inserted into both through-holes to fasten both members.

SUMMARY OF THE INVENTION

In the scroll fluid machine disclosed in JP-A-2005-337189, the parallel pin is suitable to provide good alignment accuracy, but it is not considered that the parallel pin is unsuitable to seal compressed air. Thus, the parallel pin insufficiently seals compressed fluid, thereby insufficiently improving the compression efficiency. In addition, since compressed fluid leaking from the gap between the positioning parallel pin and the through-hole is at high temperature, it is hard to reduce heat deterioration of a bearing and lubricant such as grease and to reduce grease leakage, thereby insufficiently improving the reliability.

In view the foregoing, it is an object of the present invention to provide a scroll fluid machine that may position an orbiting scroll member and a backside plate accurately and improve the compression efficiency and the reliability using a member for sealing a through-hole.

To solve the above-mentioned problems, the present invention provides a scroll fluid machine including: a fixed scroll; an orbiting scroll opposed to the fixed scroll, the orbiting scroll orbiting with a plurality of compression chambers formed between the orbiting scroll and the fixed scroll; a drive shaft driving the orbiting scroll; and a backside plate provided between the drive shaft and the orbiting scroll, an alignment hole being provided in each of the orbiting scroll and the backside plate, and an alignment pin for alignment and a seal member for sealing the compression chambers being provided in the alignment holes.

The present invention may provide a scroll fluid machine that may position an orbiting scroll member and a backside plate accurately and improve the compression efficiency and the reliability using a member for sealing a through-hole.

Other objects, features and advantages of the invention will become apparent from the following description of the embodiments of the invention taken in conjunction with the accompanying drawings.

DESCRIPTION OF THE EMBODIMENTS

With reference to the accompanying drawings, the present invention will be described in more detail using an example of a scroll air compressor as a scroll fluid machine according to embodiments of the present invention.

Embodiment 1

Figure 1:
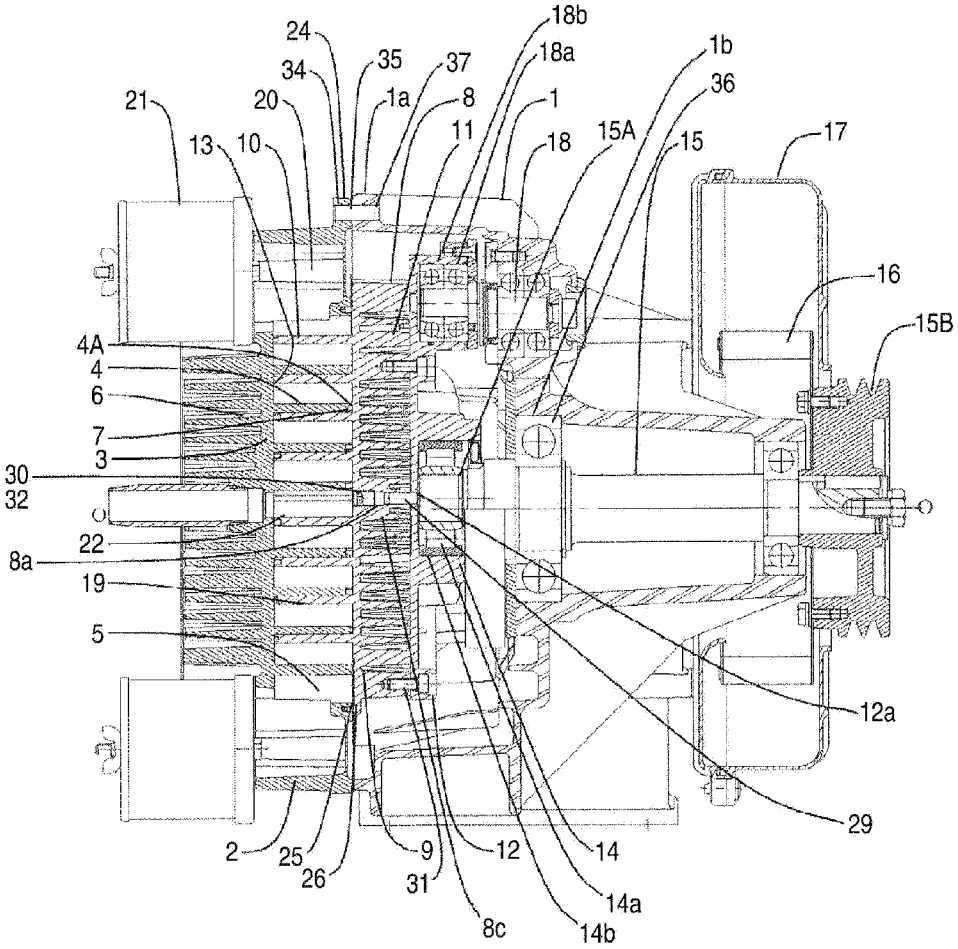
FIG. 1 is a cross-sectional view of a scroll fluid machine according to an embodiment 1 of the present invention.
Figure 2:
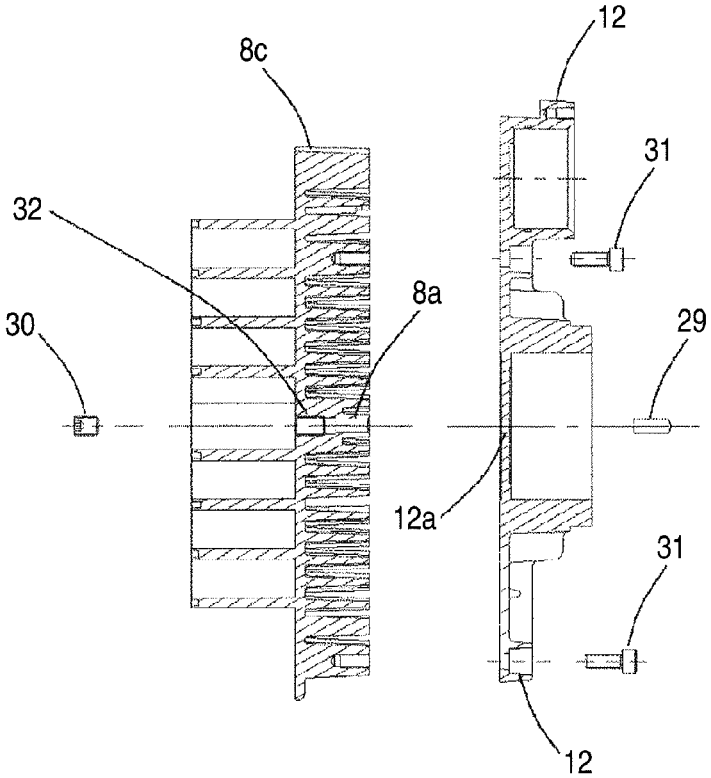
FIG. 2 is a partial cross section of the scroll fluid machine according to Embodiment 1 of the present invention.

With reference to FIGS. 1 and 2, Embodiment 1 of the present invention will be described.

FIG. 1 is a cross-sectional view of a scroll fluid machine according to this embodiment. FIG. 2 is a cross-sectional view of, among others, an orbiting scroll 8 and a backside plate 12 in the scroll fluid machine.

With reference to FIG. 1, a configuration of a scroll compressor will be described.

A casing 1 is cylindrically formed and rotatably supports therein a drive shaft 15 described below.

The casing 1 includes a fixed scroll 2 provided on the opening side thereof. With reference to FIG. 1, the fixed scroll 2 mainly includes: an end plate 3 that is generally disk-shaped around the axis line O-O; a spiral wrap portion 4 that is vertically arranged on a surface of the end plate 3 which is the bottom land, in the axial direction; a cylindrical periphery wall portion 5 that is provided on the outer diameter side of the end plate 3, the periphery wall portion surrounding the wrap portion 4; and a plurality of cooling fins 6 that are projected on the backside of the end plate 3.

Here, assuming that the innermost diameter end is the winding start end and the outermost diameter end is the winding finish end, for example, the wrap portion 4 is formed in a spiral of, for example, about three windings from the inner diameter side to the outer diameter side. Then, the top land of the wrap portion 4 is spaced apart at a certain distance in the axial direction from the bottom land of the end plate 9 of the corresponding orbiting scroll 8.

In addition, the top land of the wrap portion 4 has a seal groove 4A thereon in the winding direction of the wrap portion 4. The seal groove 4A has therein a chip seal 7. The chip seal 7 is a seal member in slidable contact with the end plate 9 of the orbiting scroll 8. Further, the periphery wall portion 5 is generally circular and opened on the end surface of the fixed scroll 2. Then, the periphery wall portion 5 is disposed on the outer diameter side of the wrap portion 10 to avoid the interference with the wrap portion 10 of the orbiting scroll 8.

The orbiting scroll 8 is orbitably provided in the casing 1. The orbiting scroll 8 mainly includes: an end plate 9 that is generally disk-shaped and opposed to the end plate 3 of the fixed scroll 2; a spiral wrap portion 10 that is vertically arranged on a surface of the end plate 9 which is the bottom land; and a plurality of cooling fins 11 that are projected on the backside of the end plate 9. In addition, the backside plate 12 is provided on the end sides of the cooling fins 11. The backside plate 12 connects the orbiting scroll 8 and the drive shaft 15.

Here, almost like the wrap portion 4 of the fixed scroll 2, the wrap portion 10 is formed in a spiral of, for example, about three windings. Then, the top land of the wrap portion 10 is spaced apart at a certain distance in the axial direction from the bottom land of the end plate 3 of the corresponding fixed scroll 2. In addition, the top land of the wrap portion 10 has a seal groove 10A thereon in the winding direction of the wrap portion 10. The seal groove 10A has therein a chip seal 13. The chip seal 13 is a seal member in slidable contact with the end plate 3 of the fixed scroll 2.

In addition, the backside plate 12 has a cylindrical boss portion 14 integrally formed on its center side. The boss portion 14 is rotatably coupled to a crank portion 15A of the drive shaft 15 via an orbiting bearing 14*a* or the like. Then, the drive shaft 15 has a pulley 15B on its one end side, the pulley 15B being outside the casing 1. The pulley 15B is coupled to, for example, the output side of an electric motor as a drive source via a belt (either not shown) or the like. The drive shaft 15 is thus rotationally driven by the electric motor or the like to orbit the orbiting scroll 8 with respect to the fixed scroll 2.

In addition, the pulley 15B has a cooling fan 16 attached thereto using bolts or the like. The cooling fan 16 generates cooling wind in a fan casing 17. The cooling fan 16 thus sends the cooling wind to the inside of the casing 1 and the backsides of the scrolls 2 and 8 along a duct in the fan casing 17 to cool the casing 1, the fixed scroll 2, and the orbiting scroll 8 or the like.

Further, an auxiliary crank 18 is provided between the outer diameter side of the backside plate 12 and the casing 1. The auxiliary crank 18 serves as a rotation-preventing mechanism to prevent the rotation of the orbiting scroll 8. The number of auxiliary cranks 18 is, for example, three (only one is shown).

A plurality of compression chambers 19 are provided between the fixed scroll 2 and the orbiting scroll 8. The compression chambers 19 are located between the wrap portions 4 and 10, and are sequentially formed from the outer diameter side to the inner diameter side. The compression chambers 19 are airtightly held by the chip seals 7 and 13. Then, as the orbiting scroll 8 orbits in the forward direction, each of the compression chambers 19 moves from the outer diameter side to the inner diameter side of the wrap portions 4 and 10, and are continuously reduced between the wrap portions 4 and 10.

The compression chambers 19 include a compression chamber 19A that is located on the outermost diameter side. The compression chamber 19A sucks external air from a suction opening 20 described below. The air is compressed into compressed air before it reaches a compression chamber 19B located on the innermost diameter side. Then, the compressed air is discharged from a discharge opening 22 and stored in an external storage tank (not shown).

The suction opening 20 is provided on the outer diameter side of the fixed scroll 2. The suction opening 20 is opened from the outer diameter side of the end plate 3 to the periphery wall portion 5. The suction opening 20 communicates with the compression chamber 19A located on the outermost diameter side. The suction opening 20 is also opened in a range of the end plate 3 of the fixed scroll 2 that is located on the outer diameter side of the wrap portion 10 of the orbiting scroll 8 and with which the chip seal 13 is not in slidable contact (a non-sliding region). Then, the suction opening 20 is configured to suck, for example, the atmospheric pressure air into the compression chamber 19A located on the outermost diameter side through the suction filter 21.

Note that the suction opening 20 may be configured to suck pressurized air. Then, the suction filter 21 may be removed and the suction opening 20 may be connected to piping supplied with pressurize air.

The discharge opening 22 is provided on the inner diameter side (center side) of the end plate 3 of the fixed scroll 2. The discharge opening 22 is configured to communicate with the compression chamber 19B located on the innermost diameter side and discharge the compressed air out of the compression chamber 19B.

A flange 24 is located on an outer side than the wrap portion 4 is. The flange 24 is configured to secure the fixed scroll 2 to the casing 1.

A face seal groove 25 is provided on the end surface of the fixed scroll 2, the end surface facing the end plate 9 of the orbiting scroll 8. The face seal groove 25 is located on the outer diameter side of the periphery wall portion 5. The face seal groove 25 is formed in an annular shape surrounding the periphery wall portion 5. In addition, the face seal groove 25 has an annular face seal 26 attached therein. Then, the face seal 26 airtightly seals the gap between the end surface of the fixed scroll 2 and the end plate 9 of the orbiting scroll 8 to prevent the sucked air from leaking from the gap to the periphery wall portion 5.

With reference to FIG. 1, a configuration regarding the positioning of the wrap portion 4 of the fixed scroll 2 will be described. The fixed scroll 2 has a plurality of positioning holes 34 provided on the flange 24 portion for high accurate positioning of the wrap portion 4. The positioning holes 34 are positioned with respective positioning holes 37 for high accurate positioning provided on the flange 1*a* of the casing 1 using respective positioning pins 35. The positioning holes 37 are provided with high accuracy with respect to the housing 1*b* of the main bearing 36, the main bearing 36 for holding the main axis 15 of the casing 1. Thus, the radial center position of the main axis 15 and the radial position of the wrap portion 4 of the fixed scroll may be positioned with high accuracy.

With reference to FIG. 2, a configuration regarding the positioning of the wrap portion 10 of the orbiting scroll 8 will be described. The backside plate 12 is provided between the orbiting scroll 8 and the drive shaft 15 and connects the orbiting scroll 8 and the drive shaft 15. The backside plate 12 undergoes a compressive load or a centrifugal force or the like applied to the orbiting scroll 8. The backside plate 12 thus has bearing housings 14*b* and 18*b* provided thereon for holding the orbiting bearing 14*a* and an auxiliary crank bearing 18*a*. In addition, the backside plate 12 has, on its center, a through-hole 12*a* as an alignment hole for high accurate alignment, the through-hole 12*a* being manufactured at the same time (in the same process) as the bearing housings 14*b* and 18*b*. Note that for easier manufacturing, the alignment hole is formed to pass through the backside plate 12 as the through-hole 12*a*. For higher accuracy alignment, the through-hole 12*a* is provided on an inner side at least than the drive shaft 15 (the outer surface of the crank portion 15A of the drive shaft 15) is. The orbiting scroll 8, which includes the end plate 9, the wrap portion 10, and the cooling fin 11, also includes a wrap member 8*c*. The wrap member 8*c* has, on its wrap center, a through-hole 8*a* as an alignment hole for high accurate alignment, the through-hole 8*a* being manufactured at the same time (in the same process) as the wrap manufacturing. After positioning the through-holes 12*a* and 8*a* using an alignment pin 29 for high accurate alignment, the backside plate 12 and the orbiting scroll 8 are fastened with a plurality of bolts 31.

The alignment pin 29 is pressed into the through-holes 12*a* and 8*a* and set to prevent the position shift. In addition, the alignment pin 29 has no screw groove (or protrusion) provided thereon, thereby improving the alignment accuracy. Further, to reliably prevent the grease leakage in the orbiting bearing, sealant such as adhesive may be applied in the small gap (surface roughness level) between the alignment pin 29 and the through-holes 12*a* and 8*a*.

Here, in the scroll fluid machine disclosed by JP-A-2005-337189, the wrap member of the orbiting scroll and the backside plate are positioned and fastened using a through-hole and a parallel pin. The parallel pin is excellent in the alignment accuracy, but it is not considered that the parallel pin does not provide a high sealing function. In addition, the through-hole is provided on the center side of the orbiting scroll and the compression chamber on the center side of the orbiting scroll has a high pressure. Therefore, when the machine is used as a fluid machine, particularly as a compressor, the fluid easily leaks from the through-hole, preventing the improvement of the compression efficiency.

Therefore, with reference to FIG. 2, this embodiment of the present invention performs the alignment using the alignment pin 29 suitable for the alignment and includes, in the through-hole 8*a* on the orbiting scroll 8 side, a sealing member (seal member) 30 closer to the axial orbiting scroll 8 side than the alignment pin 29 is, the sealing member 30 being a member different from the alignment pin 29. This may provide high accurate positioning, while preventing the compressed fluid from leaking out of the wrap. Note that sealant such as adhesive may be filled between the sealing member 30 and the through-hole 8*a* to further improve the sealing characteristics.

Here, the sealing member 30 may have a larger diameter than the alignment pin 29 and accordingly, in the through-hole 8*a* provided on the orbiting scroll 8 side, the portion receiving the sealing member 30 may have a larger diameter than the portion receiving the alignment pin 29. This may prevent the sealing member 30 from being inserted too much and pushing out the alignment pin 29. In addition, the sealing member 30 may have a screw groove (or protrusion), and in the through-hole 8*a*, the portion receiving the sealing member 30 may have a screw groove (or protrusion) 32 corresponding to the screw groove (or protrusion) of the sealing member 30. Thus, the sealing member 30 and the through-hole 8*a* may be securely fastened with a screw, thereby improving the sealing characteristics. Further, a sealant may be applied to or wound around the sealing member 30 before inserting the sealing member 30. Thus, the gap between the sealing member 30 including a screw groove formed thereon and the female screw 32 may be sealed with a sealant, thus improving the sealing characteristics.

Note that rotational deviation between the wrap 10 of the orbiting scroll 8 and the auxiliary crank bearing 18*a* provided on the backside plate 12 is prevented as follows. A through-hole (not shown) for rotational positioning is provided on the backside plate 12 and radially outward from the drive shaft 15. A hole (not shown) corresponding to that through-hole position is provided on the orbiting scroll 8. The wrap 10 and the auxiliary crank bearing 18*a* are temporarily positioned using a pin or the like (not shown) having a certain gap (backlash) with respect to both holes. The wrap 10 and the bearing 18*a* are then fastened using bolts 31 or the like and the pins are removed. Here, the pin for the rotational positioning may be left inserted in the member by bonding or the like.

Thus, according to this embodiment, the wrap member 8*c* of the orbiting scroll 8 and the backside plate 12, i.e., the wrap portion 10 (swirl) and the bearings 14*a* and 18*a* may be positioned with high accuracy, and the wrap member 8*c* including the sealing member 30 in the through-hole 8*a* may prevent the leak of the compressed fluid, thereby improving the compression efficiency and the reliability.

Embodiment 2

Figure 3:
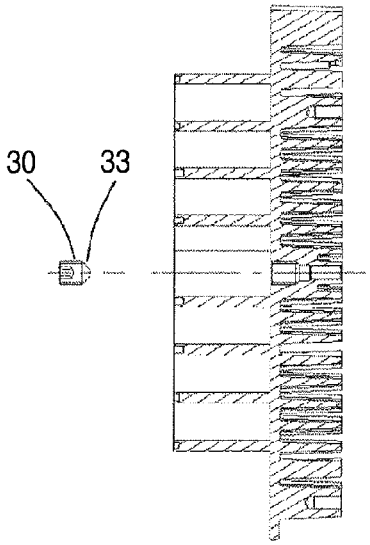
FIG. 3 is a partial cross section of a scroll fluid machine according to an embodiment 2 of the present invention.

With reference to FIG. 3, Embodiment 2 of the present invention will be described. Like elements as those in Embodiment 1 are designated with like reference numerals and their detailed description is omitted here. This embodiment has a feature that the sealing member 30 has a taper portion 33 provided on its end (on the drive shaft 15 side thereof), the taper portion 33 decreasing in diameter toward the end (on the drive shaft 15 side thereof). The sealing member 30 is inserted into the through-hole 8*a* of the wrap member 8*c* as described above. The portion (closer to the drive shaft 15 side than the screw groove 32 is) of the through-hole 8*a* that is to be in contact with the taper portion 33 is also tapered to decrease in diameter toward the drive shaft 15 side. Thus, the sealing member 30 may be fastened to bring the tapered surfaces of the sealing member 30 and the through-hole 8*a* in close contact with each other and to seal therebetween.

This embodiment may provide more contact area than Embodiment 1, thus further improving the sealing characteristics. In addition, generally available generic parts such as a setscrew (cone point) may be readily used.

Embodiment 3

Figure 4:
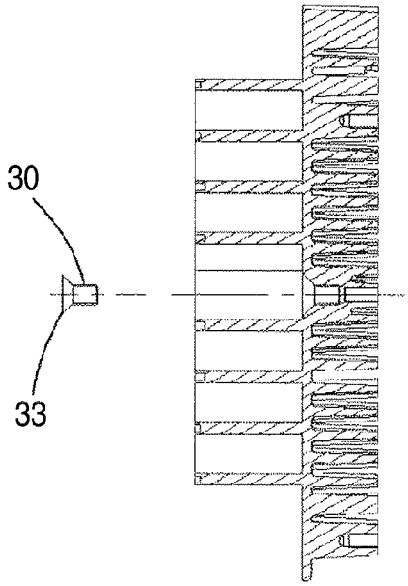
FIG. 4 is a partial cross section of a scroll fluid machine according to an embodiment 3 of the present invention.

With reference to FIG. 4, Embodiment 3 of the present invention will be described. Like elements as those in Embodiments 1 and 2 are designated with like reference numerals and their detailed description is omitted here. This embodiment has a feature that the sealing member 30 has a taper portion 33 provided on its end (on the compression chamber 19 side thereof), the taper portion 33 increasing in diameter toward the end (on the compression chamber 19 side thereof). The sealing member 30 is inserted into the through-hole 8*a* of the wrap member 8*c* as described above. The portion (closer to the drive shaft 15 side than the screw groove 32 is) of the through-hole 8*a* that is to be in contact with the taper portion 33 is also tapered to increase in diameter toward the compression chamber 19 side.

This embodiment may increase the contact area between the tapered surfaces, thereby further improving the sealing characteristics. In addition, generally available generic parts such as a flat head bolt and a flat head screw may be used.

Embodiment 4

Figure 5:
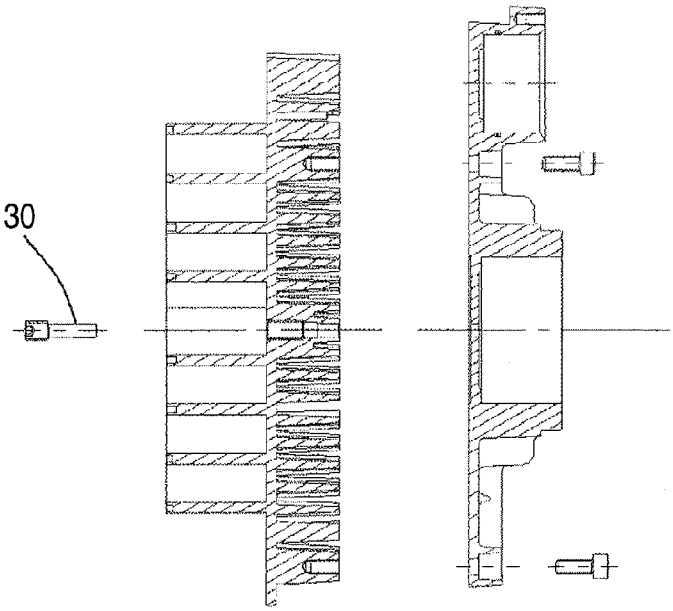
FIG. 5 is a partial cross section of a scroll fluid machine according to an embodiment 4 of the present invention.
Figure 6:
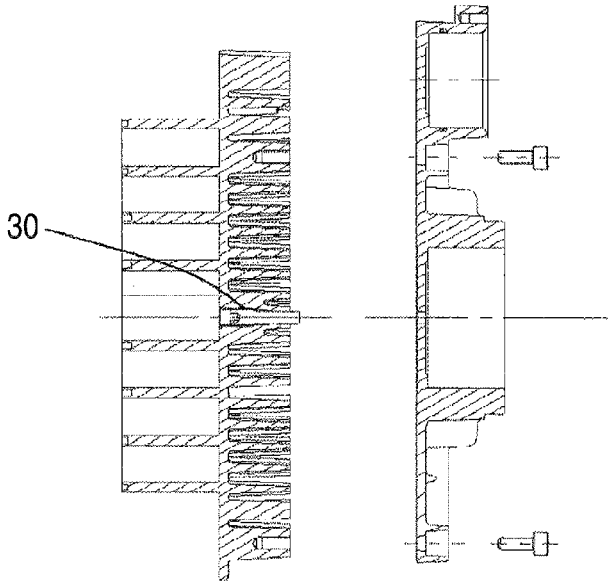
FIG. 6 is a partial cross section of the scroll fluid machine according to Embodiment 4 of the present invention.

With reference to FIGS. 5 and 6, Embodiment 4 of the present invention will be described. Like elements as those in Embodiments 1-3 are designated with like reference numerals and their detailed description is omitted here.

This embodiment has a feature that the sealing member 30 and the alignment pin 29 in Embodiments 1-3 are integrated. Like Embodiments 1-3, the portion (on the compression chamber 19 side) corresponding to the sealing member 30 has a screw groove or a protrusion provided thereon, and the portion (on the drive shaft 15 side) corresponding to the alignment pin 29 has no screw groove or protrusion provided thereon.

This embodiment may reduce the number of parts and assembling steps.

Embodiment 5

Figure 7:
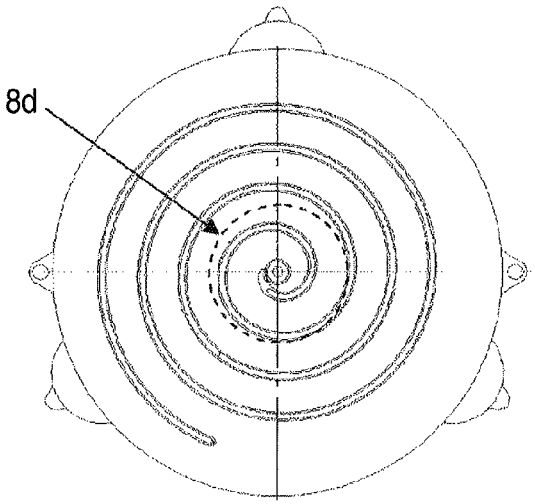
FIG. 7 is a front view of an orbiting scroll wrap according to an embodiment 5 of the present invention.
Figure 8:
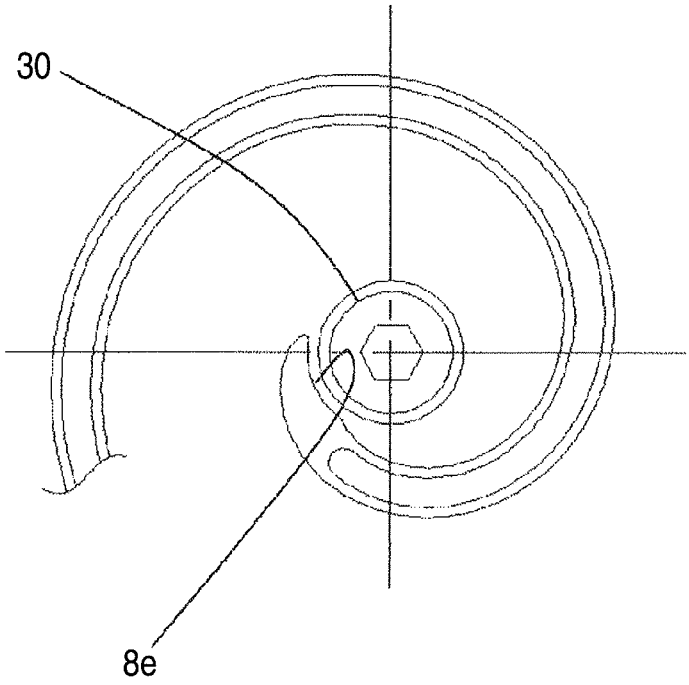
FIG. 8 is an enlarged front view of the central portion of the orbiting scroll wrap according to Embodiment 5 of the present invention.

With reference to FIGS. 7 and 8, Embodiment 5 of the present invention will be described. Like elements as those in Embodiments 1-4 are designated with like reference numerals and their detailed description is omitted here.

FIGS. 7 and 8 show the orbiting scroll wrap member 8*c* provided with the sealing member 30 as viewed in the longitudinal direction of the drive shaft. This embodiment has a feature that in the central portion 8*d* (winding start) of the wrap portion 10 of the orbiting scroll 8, a notch portion is formed in the inner wall portion 8*e* of the central portion 8*d* to provide the sealing member 30.

In this embodiment, if the orbiting scroll 8 has a small orbiting radius and it is hard to provide the through-hole 8*a* and the sealing member 30 (in particular, the taper portion 33 in Embodiment 3), the notch of the inner wall portion 8*e* of the wrap central portion 8*d* may facilitate the formation of the through-hole 8*a* and the sealing member 30.

Although the embodiments have been described with respect to the scroll air compressor as the scroll fluid machine, the present invention is not limited thereto. The invention is also applicable to other scroll fluid machines such as a coolant compressor for compressing a coolant and a vacuum pump etc. The invention is also applicable to a system including a scroll fluid machine, such as a package compressor integrated with tank and a nitrogen gas generator.

The embodiments described so far only show examples of the implementation to practice the present invention, and they do not construe the scope of the invention in a limited manner. In other words, the present invention may be implemented in various forms without departing from the technical idea and the main features thereof In addition, Embodiments 1 to 5 may be combined to implement the present invention.

The invention claimed is:

1. A scroll fluid machine comprising:

a fixed scroll;

an orbiting scroll opposed to the fixed scroll, the orbiting scroll orbiting with a plurality of compression chambers formed between the orbiting scroll and the fixed scroll;

a drive shaft driving the orbiting scroll; and a backside plate provided between the drive shaft and the orbiting scroll, wherein an alignment hole which is a through-hole is provided in each of the orbiting scroll and the backside plate, and an alignment pin that is structurally configured to align the orbiting scroll and the backside plate and a seal member that is structurally configured to seal the compression chambers are provided in the alignment hole.

2. The scroll fluid machine according to claim 1, wherein the alignment hole rotates within a radial boundary that is defined by an outer longitudinal edge of the drive shaft.

3. The scroll fluid machine according to claim 1, wherein the alignment pin has no screw groove or protrusion thereon.

4. The scroll fluid machine according to claim 1, wherein the seal member includes a screw groove or a protrusion thereon.

5. The scroll fluid machine according to claim 1, wherein the seal member has a larger diameter than the alignment pin.

6. The scroll fluid machine according to claim 1, wherein a sealant is filled between the seal member and the alignment hole.

7. The scroll fluid machine according to claim 1, wherein the seal member has a tapered end.

8. The scroll fluid machine according to claim 1, wherein the alignment pin and the seal member are formed integrally.

9. The scroll fluid machine according to claim 1, wherein a notch portion is formed on a center-side inner wall of a wrap portion of the orbiting scroll.

10. The scroll fluid machine according to claim 1, wherein the alignment pin is provided in the alignment hole of an orbiting scroll side and alignment hole of a backside plate side, and the seal member is provided in the alignment hole of the orbiting scroll side.

11. A scroll fluid machine comprising:

a fixed scroll;

an orbiting scroll opposed to the fixed scroll, the orbiting scroll orbiting with a plurality of compression chambers formed between the orbiting scroll and the fixed scroll;

a drive shaft driving the orbiting scroll; and a backside plate provided between the drive shaft and the orbiting scroll, wherein an alignment hole which is a through-hole is provided in each of the orbiting scroll and the backside plate, and an alignment pin that is structurally configured to align the orbiting scroll and the backside plate, and that has no screw groove or protrusion thereon and a seal member having a screw groove or a protrusion thereon are provided in the alignment hole.

12. The scroll fluid machine according to claim 11, wherein the alignment hole rotates within a radial boundary that is defined by an outer longitudinal edge of the drive shaft.

13. The scroll fluid machine according to claim 11, wherein the seal member has a larger diameter than the alignment pin.

14. The scroll fluid machine according to claim 11, wherein a sealant is filled between the seal member and the alignment hole.

15. The scroll fluid machine according to claim 11, wherein the seal member has a tapered end.

16. The scroll fluid machine according to claim 11, wherein the alignment pin and the seal member are formed integrally.

17. The scroll fluid machine according to claim 11, wherein the seal member is provided closer to the orbiting scroll side than the alignment pin is.

18. The scroll fluid machine according to claim 11, wherein the alignment pin is provided in the alignment holes of the orbiting scroll side and the alignment hole of a backside plate side, and the seal member is provided in the alignment hole closer to the orbiting scroll side than the backside plate side.

19. A scroll fluid machine comprising:

a fixed scroll;

an orbiting scroll opposed to the fixed scroll, the orbiting scroll orbiting with a plurality of compression chambers formed between the orbiting scroll and the fixed scroll;

a drive shaft driving the orbiting scroll; and a backside plate provided between the drive shaft and the orbiting scroll, wherein an alignment hole which is a through-hole is provided in each of the orbiting scroll and the backside plate, and an alignment pin for alignment and a seal member for sealing the compression chambers are provided in the alignment hole, and the alignment pin and the seal member are formed integrally.

* * * * *